US007107728B2

(12) United States Patent
Whitley

(10) Patent No.: US 7,107,728 B2
(45) Date of Patent: Sep. 19, 2006

(54) APPARATUS FOR THE STORAGE OF HAZARDOUS MATERIALS

(75) Inventor: Andrew Ronald Whitley, Cheshire (GB)

(73) Assignee: British Nuclear Fuels Plc, Cheshire (GB)

( * ) Notice: Subject to any disclaimer, the term of this patent is extended or adjusted under 35 U.S.C. 154(b) by 113 days.

(21) Appl. No.: 10/276,122

(22) PCT Filed: May 10, 2001

(86) PCT No.: PCT/GB01/02062

§ 371 (c)(1),
(2), (4) Date: Jul. 21, 2003

(87) PCT Pub. No.: WO01/91133

PCT Pub. Date: Nov. 29, 2001

(65) Prior Publication Data

US 2004/0041071 A1 Mar. 4, 2004

(30) Foreign Application Priority Data

May 23, 2000 (GB) ..... 0012321.6

(51) Int. Cl.
*E04H 9/02* (2006.01)

(52) U.S. Cl. ..... 52/167.4; 52/167.7; 52/167.8; 52/167.1; 108/53.1; 211/71.01; 248/562; 248/636

(58) Field of Classification Search ..... 52/167.1, 52/167.4, 167.5, 167.6, 167.9, 167.7, 167.8; 108/53.1; 211/59.4, 71.01; 248/562, 580, 248/636; 220/917; 206/821
See application file for complete search history.

(56) References Cited

U.S. PATENT DOCUMENTS

| | | | | |
|---|---|---|---|---|
| 4,565,039 | A * | 1/1986 | Oguro et al. | 52/167.4 |
| 4,593,526 | A | 6/1986 | Pankowiecki | |
| 4,599,834 | A * | 7/1986 | Fujimoto et al. | 52/167.8 |
| 4,793,105 | A | 12/1988 | Caspe | |
| 5,191,356 | A * | 3/1993 | Shibamiya | 347/188 |
| 5,636,753 | A * | 6/1997 | Wilkinson et al. | 211/59.4 |
| 5,816,559 | A * | 10/1998 | Fujimoto | 248/636 |
| 5,829,362 | A * | 11/1998 | Evans et al. | 108/55.1 |
| 5,970,666 | A * | 10/1999 | Kurabayashi et al. | 52/167.6 |
| 6,085,472 | A * | 7/2000 | Malhotra | 52/167.4 |
| 6,216,991 | B1 * | 4/2001 | Okamoto | 248/188.1 |
| 6,467,961 | B1 * | 10/2002 | Nakamaru et al. | 384/13 |
| 6,648,295 | B1 * | 11/2003 | Herren et al. | 248/636 |

FOREIGN PATENT DOCUMENTS

| | | |
|---|---|---|
| EP | 1005049 A1 | 11/1999 |
| JP | 8194092 | 7/1996 |
| JP | 09210121 | 12/1997 |
| JP | 10177094 | 6/1998 |
| JP | 11000269 | 1/1999 |
| JP | 11153187 | 6/1999 |
| JP | 11208819 | 8/1999 |
| JP | 11294752 | 10/1999 |
| WO | WO 95/33268 | 12/1995 |
| WO | WO 95/33269 | 12/1995 |

* cited by examiner

*Primary Examiner*—Carl D. Friedman
*Assistant Examiner*—Jennifer I. Thissell
(74) *Attorney, Agent, or Firm*—Robert L. Stearns; Dickinson Wright PLLC

(57) ABSTRACT

The invention provides a stabilizing device for inclusion in a stack of containers in which hazardous waste is held, wherein the stabilizing device comprises a table for supporting a container in the stack, and a base, the table being movable relative to the base so as to aid stability of the stack when the stack is subjected to external forces.

16 Claims, 3 Drawing Sheets

APPARATUS FOR THE STORAGE OF HAZARDOUS MATERIALS

The present invention relates to apparatus for the storage of hazardous material, such as radioactive waste, the material being stored in containers arranged in a stack formation. More particularly, the invention relates to a stabilizing device for incorporation in a stack of containers so as to aid stability of the stack when subjected to external forces, such as those resulting from a seismic event.

BACKGROUND OF THE INVENTION

In one known method for the disposal of radioactive waste, the waste is placed in boxes and then covered with a cementitious grout which is injected into the box. After a curing period, a capping grout is introduced into the box in order to seal the waste and to remove any ullage space where gases can accumulate. After a further curing period, a lid is fixed to the box, which is then subjected to a decontamination process. The boxes are transferred to a heavily-shielded storage building where they are deposited in rows of vertical stacks by a remotely-operated crane.

In an alternative storage system, the waste is encapsulated in a cementitious matrix inside a stainless steel drum. Several drums are placed in a stillage and the stillages are formed into a vertical stack using a remotely-operated crane.

The boxes or stillages may have to be stored for a very long period of time of, say, 100 years. During that period, it is desirable that the storage building and stacks of boxes or stillage are able to withstand not only operational loads, but also seismic and other extreme environmental conditions.

It is an object of this invention to provide apparatus for storing hazardous material in which a stack of containers holding the material remains stable when subjected to external forces, such as those generated during a seismic event.

SUMMARY OF THE INVENTION

According to a first aspect of the invention there is provided a stabilizing device for inclusion in a stack of containers in which holding hazardous waste is held, wherein the stabilizing device comprises a table for supporting a container in the stack, and a base, the table being movable relative to the base so as to aid stability of the stack when the stack is subjected to external forces.

Preferably, the table is mounted on the base.

In a preferred embodiment, the table has a lower surface resting on an upper surface of the base, the lower surface being adapted for sliding movement on the upper surface.

The table may be generally rectangular in shape with a foot member depending from each corner thereof, each foot having a surface defining the lower surface of the table.

A lubricant may be applied to at least one of the said upper and lower surfaces.

Preferably, the lubricant is applied to each of the upper and lower surfaces.

A preferred lubricant is molybdenum disulphide.

The coefficient of friction between the upper and lower surfaces preferably lies in the range of 0.05 to 0.1.

Preferably, the base is provided with locating means for engagement with a container arranged below the stabilizing device.

The locating means may comprise a plurality of projections extending from a lower surface of the base, the projections being adapted to locate in apertures provided in a container arranged below the stabilizing device.

The relative movement of the table with respect to the base is preferably restricted by a resilient buffer means, the buffer means being located so as to be contacted by the table upon movement of the table relative to the base.

Preferably, the resilient buffer means are mounted on the base and wherein a bumper member depends from the table, the bumper member being adapted to be contacted by the buffer means upon movement of the table relative to the base.

Suitably, there are four resilient buffer means, the buffer means being located so that they are disposed at equiangular positions around the bumper.

The resilient buffer means preferably comprises a movable plunger which is depressed by the bumper member upon movement of the table relative to the base, the depression of the plunger being opposed by the force exerted by a spring.

Desirably, the force exerted the spring is sufficient to overcome the force exerted by the movement of the table relative to the base.

Advantageously, each of the buffer means is spaced from the bumper member.

According to a second aspect of the invention there is provided a storage system comprising a stack of containers in which hazardous waste is held, wherein a container in the stack is supported by a stabilizing device, the device comprising a base, and a table for supporting a container in the stack, the table being movable relative to the base so as to aid stability of the stack when the stack is subjected to external forces.

Preferably, the stabilizing device is interposed between a container and a next lower container.

The stabilizing device may be interposed beneath a container in the topmost position in the stack and supported by the next lower container.

The stack of containers may comprise at least nine containers.

THE DRAWINGS

The invention will now be described, by way of example, with reference to the accompanying drawings, in which.

Figure 1:
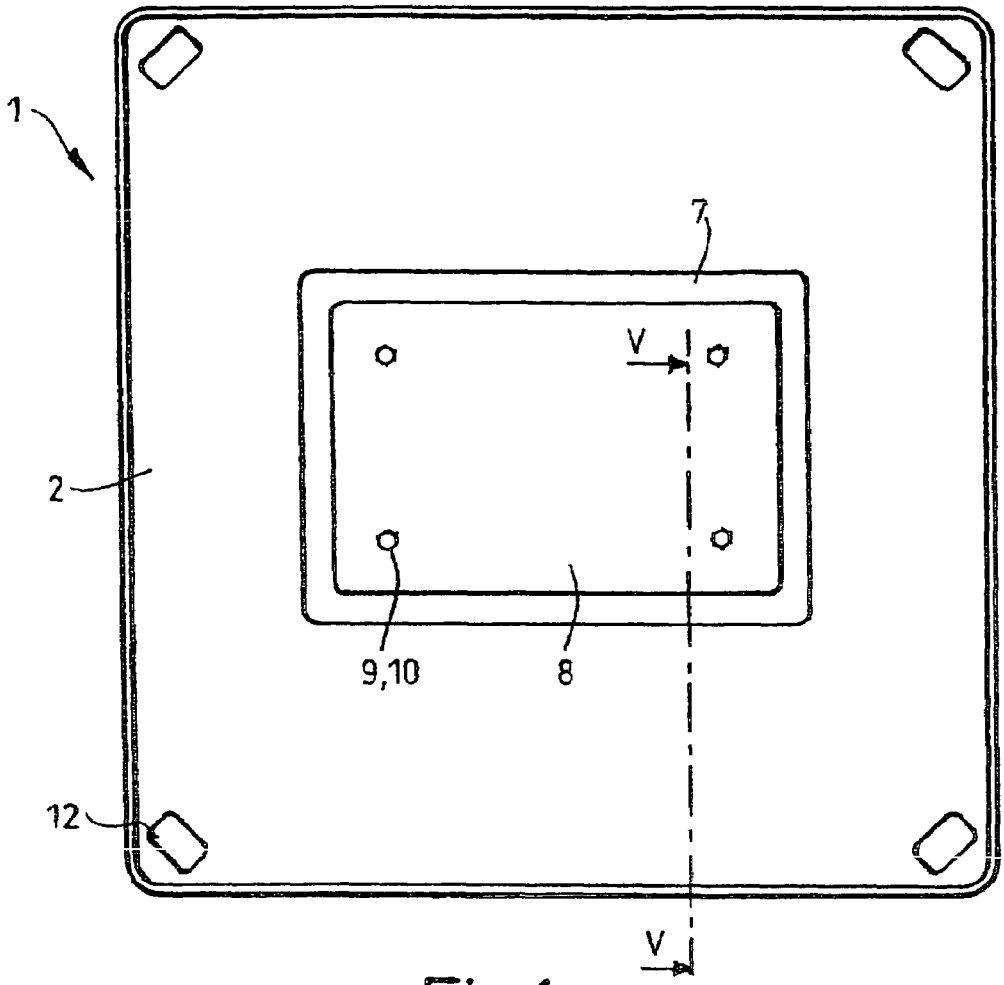
FIG. 1 is a plan view of a stabilizing device for inclusion in a stack of containers according to a preferred aspect of the invention.
Figure 2:
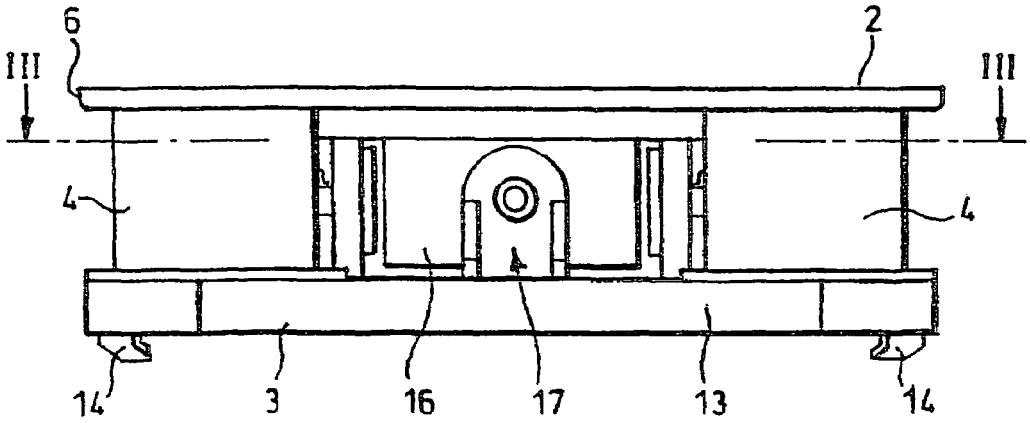
FIG. 2 is a side view of the stabilizing device shown in FIG. 1.

Referring to FIGS. 1 and 2, a stabilizing device 1 is shown which is designed for inclusion in a storage system comprising a vertical stack of containers containing hazardous material. The device 1 assists in maintaining stability of the stack of containers when the stack is subjected to external forces, such as those resulting from a seismic event.

The stabilizing device 1 comprises a table 2 and a base 3, both of which are of rectangular shape, as seen in the plan view of FIG. 1. Welded to the underside of the table 2, at each corner thereof, is a foot 4 of circular cross section. The four feet 4 rest on four surface plates 5 welded at the corners of the base 3. The lower surfaces of the feet 4 and the upper surfaces of the plates 5 are coated with a dry lubricant so as to provide the desired frictional properties between the contacting surfaces. The type of dry lubricant employed must be resistant to degradation in a highly radioactive environment while providing the required frictional coefficient between the contacting surfaces. Suitable materials include carbon composites, peek and molybdenum disulphide. The preferred dry lubricant is molybdenum disulphide which provides a desired low coefficient of friction within a range of 0.5 to 0.1 and which is resistant to degradation under radioactive conditions.

In an alternative embodiment, the surface plates 5 may incorporate, or be replaced by, rolling elements, such as roller bearings.

Figure 5:
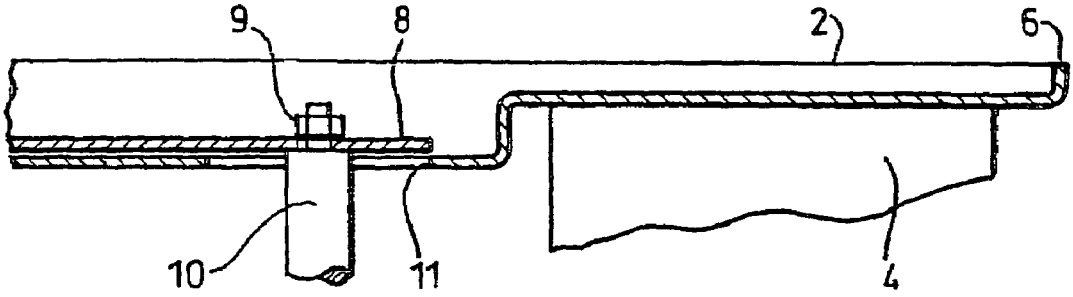
FIG. 5 is a part sectional side view of the stabilizing device taken on the line V—V shown in FIG. 1.

The table 2 is pressed from stainless steel plate so as to form a raised rim 6 and a relieved central region 7. As best seen in FIG. 5, a retaining plate 8, located in the central region 7, is secured by nuts 9 to four retaining bars 10. These bars are welded at their lower ends to the base 3. The retaining plate 8 and the bars 10 hold the table 2 and the base 3 together during installation and removal procedures. Each of the retaining bars 10 is made to a length that is sufficient to ensure that the retaining plate 8 is spaced above the central region 7 of the table 2. To permit movement of the table 2 relative to the base 3, clearance holes 11 around the retaining bars 10 are provided in the central region 7.

At each corner of the table 2 is a rectangular hole 12 which enable the device 1 to be handled by lifting equipment.

To ensure that the base 3 has the required stiffness, channel sections 13 are welded diagonally to the underside of the base. At each corner of the base 3, a locating projection 14 extends from the underside of the channel section 13. When the device 1 is incorporated in a stack of containers 151, 152, as seen in FIG. 6, the webs 14 locate in slots provided in the container 15 beneath, thereby locking the device in position.

Figure 3:
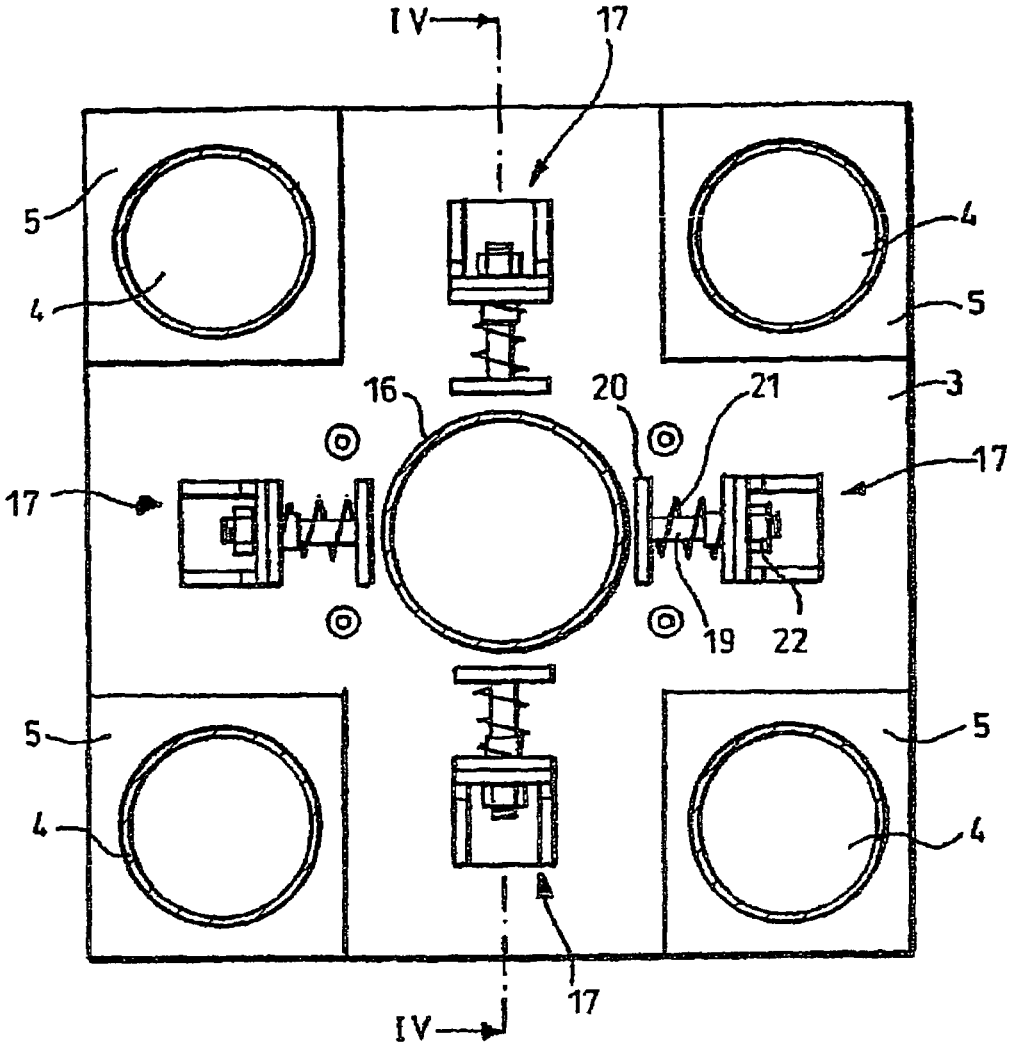
FIG. 3 is a sectional plan view of the stabilizing device taken on the line III—III shown in FIG. 2.
Figure 4:
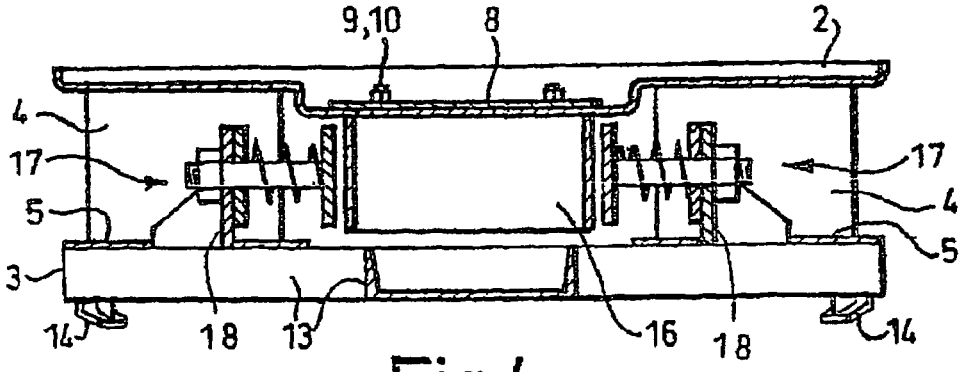
FIG. 4 is a sectional side view of the stabilizing device taken on the IV—IV in FIG. 3.

As best seen in FIGS. 3 and 4, a bumper 16 of circular cross section extends from the underside of the central region 7 of the table 2. Alternatively, the bumper 16 may have a square cross section. Four equi-spaced resilient buffers 17 are arranged around the bumper 16. Each buffer 17 comprises a bracket 18 mounted on the upper surface of the base 3. Slidably mounted in the bracket 18 is a spring-loaded plunger 19 having a head 20 spaced from the surface of the bumper 16. A coil spring 21 surrounding the plunger 19 is compressed between the head 20 and the bracket 18 so that the plunger is biased by the spring towards the bumper 16. Movement of the plunger 19 is restrained by a nut 22 arranged on the plunger, the nut 21 being positioned so as to provide a spacing of 20 mm between the head 20 and the surface of the bumper 16.

The four buffers 17 serve a dual purpose; firstly, they ensure that the table 2 is centralized and, secondly, during a seismic event, they exert a force that is sufficient to overcome the limiting friction between the table and the base, thereby moving the table back to its central position.

Figure 6:
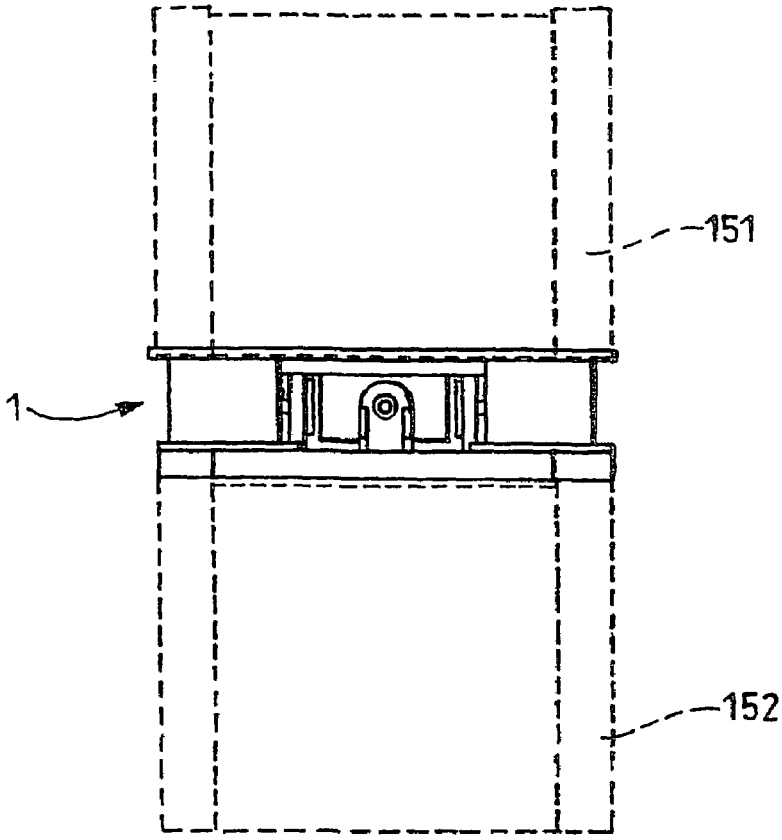
FIG. 6 illustrates the stabilizing device as shown in FIGS. 1 to 5 when included in a storage system comprising a stack of containers.

In use, the stabilizing device 1 is incorporated in a storage system comprising a stack of containers, two of which 151, 152 are indicated in FIG. 6. The containers 151, 152 which are in the form of boxes having a capacity of 3 $m^3$, are arranged one on top of another to form a vertical stack of, say, nine containers. Each container holds an amount of hazardous waste in the form of encapsulated radioaction waste.

Advantageously, the stabilizing device 1 may be positioned between the topmost container 151 and the next lower container 152.

A remotely-operated crane, utilizing the holes 12 in the table 2, deposits the stabilizing device 1 on top of the container 152 so that the projections 14 are located and locked in the holes provided at the top of the container 152. The crane then places a further container 151 on the table 2.

The weight of the container 151 is borne by the four feet 4 which rest on the four surfaces plates 5.

If the stack is subjected to external forces resulting from an earthquake, the table 2 and the container 151 supported thereby, will slide on the base 3. As a result of this movement, the bumper 16 will come into contact with a head 20 of at least one of the buffers 17. The opposing force exerted by the spring 21 of the contacted buffer is sufficient to overcome the limiting friction force between the lubricated contacting surfaces of the feet 4 and the surface plates 5. Thus, the table 2 is moved back to its central position. For effective functioning of the stabilizing device 1 it is desirable that the natural frequency of the spring 21 is different from the natural frequency of the stack.

The clearance between the buffers 17 and the bumper 16 induces a time lag in the mechanism, thereby ensuring that the forces are out of phase with those created by the earthquake. In use, therefore, the stabilizing device 1 has the effect of transferring the forces resulting from the earthquake back to the lower containers of the stack. Under earthquake conditions, therefore, the stack will remain stable and resist the tendency to topple over.

The invention claimed is:

1. A stabilizing device for inclusion in a stack of containers in which hazardous waste is held, the stabilizing device comprising a table for supporting a container in the stack, a base on which the table is mounted, a plurality of feet which depend from the table to define a lower surface of the table, the lower surface being in contact with an upper surface of the base so as to be freely slidably moveable thereover to permit movement of the table relative to the base, and wherein said relative movement is restricted by a resilient buffer structure which is mounted on the base such that bumper members which depend from the table are contacted by the buffer structure upon movement of the table relative to the base.

2. A stabilizing device according to claim 1, wherein the table is generally rectangular in shape.

3. A stabilizing device according to claim 1, wherein a lubricant is applied to at least one of the upper and lower surfaces.

4. A stabilizing device according to claim 3 wherein the lubricant is applied to each of the upper and lower surfaces.

5. A stabilizing device according to claim 3 wherein the lubricant is molybdenum disulphide.

6. The stabilizing device according to claim 4 wherein the lubricant is molybdenum disulphide.

7. A stabilizing device according to claim 1, wherein the coefficient of friction between the upper and lower surface lies in the range of 0.05 to 0.1.

8. A stabilizing device according to claim 1, wherein the base is provided with locating structure engageable with a container arranged below the stabilizing device.

9. A stabilizing device according to claim 8, wherein the locating structure comprises a plurality of projections extending from a lower surface of the base, the projections being adapted to locate in apertures provided in the container arranged below the stabilizing device.

10. A stabilizing device according to claim 9 wherein the resilient buffer structure comprises four resilient buffers, the resilient buffers being located so that they are disposed at equi-angular positions around the bumper.

11. A stabilizing device according to claim 9, wherein the resilient buffer structure comprises a movable plunger which is depressed by the bumper member upon movement of the table relative to the base, the movable plunger being spring-loaded so as to forcibly oppose the displacement of the moveable plunger by the bumper member.

12. A stabilizing device according to claim 11 wherein the spring-loading of the movable plunger is sufficient to overcome the force exerted by the movement of the table relative to the base.

13. A stabilizing device according to claim 9 wherein the buffer structure is spaced form the bumper member.

14. A storage system comprising a stack of containers in which hazardous waste is held, wherein a container in the stack is supported by a stabilizing device, the device comprising a base, and a table for supporting a container in the stack, the table being movable relative to the base so as to aid stability of the stack when the stack is subjected to external forces, and wherein the stabilizing device is interposed between a container and a next lower container.

15. A storage system according to claim 14 wherein the stabilizing device is interposed beneath a container in the topmost position in the stack and supported by the next lower container.

16. A storage system according to claim 14 wherein the stack of containers comprises at least nine containers.

* * * * *

UNITED STATES PATENT AND TRADEMARK OFFICE

CERTIFICATE OF CORRECTION

PATENT NO. : 7,107,728 B2
APPLICATION NO. : 10/276122
DATED : September 19, 2006
INVENTOR(S) : Andrew Ronald Whitley It is certified that error appears in the above-identified patent and that said Letters Patent is hereby corrected as shown below:

Column 1. line 1: “relates to apparatus” should be --relates to an apparatus--.
Column 1, line 33: “to provide apparatus” should be --to provide an apparatus--.
Column 1, line 54: “one of the said” should be --on of the--.
Column 2, line 18: “force exerted the spring” should be --force exerted by the spring--.
Column 3, line 11: “range of 0.5 to 0.1” should be --range of 0.05 to 0.1--.
Column 3, line 51: “the nut 21” should be --the nut 22--.
Column 3, line 51: “on the plunger” should be --on the plunger 19--.
Column 3, line 66: “encapsulated radioaction” should be --encapsulated radioactive--.
Column 4, line 10: “four surfaces plates” should be --four surface plates--.
Column 4, line 51: “claim 3 wherein” should be --claim 3, wherein--.
Column 4, line 53: “claim 3 wherein” should be --claim 3, wherein--.
Column 4, line 55: “claim 4 wherein” should be --claim 4, wherein--.
Column 5, line 1: “claim 9 wherein” should be --claim 9, wherein--.
Column 5, line 11: “claim 11 wherein” should be --claim 11, wherein--.
Column 5, line 15: “claim 9 wherein” should be --claim 9, wherein--.
Column 5, line 16: “spaced form” should be --spaced from--.
Column 6, line 9: “claim 14 wherein” should be --claim 14, wherein--.
Column 6, line 13: “claim 14 wherein” should be --claim 14, wherein--.

Signed and Sealed this

Sixth Day of March, 2007

JON W. DUDAS
*Director of the United States Patent and Trademark Office*